US007798684B2

(12) United States Patent
Boissevain

(10) Patent No.: US 7,798,684 B2
(45) Date of Patent: Sep. 21, 2010

(54) LUMINAIRE SYSTEM WITH THERMAL CHIMNEY EFFECT

(75) Inventor: Chris Boissevain, Wimberley, TX (US)

(73) Assignee: Genlyte Thomas Group LLC, Burlington, MA (US)

( * ) Notice: Subject to any disclaimer, the term of this patent is extended or adjusted under 35 U.S.C. 154(b) by 0 days.

(21) Appl. No.: 11/697,325

(22) Filed: Apr. 6, 2007

(65) Prior Publication Data

US 2008/0285265 A1 Nov. 20, 2008

(51) Int. Cl.
*F21S 8/00* (2006.01)
*F21V 29/00* (2006.01)

(52) U.S. Cl. ..... 362/431; 362/294; 362/373; 362/314; 362/547; 362/345; 361/688; 361/689; 361/690; 361/692

(58) Field of Classification Search ..... 362/294, 362/373, 314, 431, 547, 345; 361/688–690, 361/692
See application file for complete search history.

(56) References Cited

U.S. PATENT DOCUMENTS 492,320 A 2/1893 Bodkin
1,484,978 A 2/1924 Wheeler
2,428,630 A 10/1947 Lanter
3,225,224 A * 12/1965 Rydbeck ..... 307/157
3,311,743 A 3/1967 Moore
3,845,292 A 10/1974 Koziol
3,890,126 A 6/1975 Joseph
4,321,656 A 3/1982 Gruver, Jr.
4,503,360 A 3/1985 Bedel
4,734,835 A 3/1988 Vines et al.
4,871,944 A 10/1989 Skwirut et al.
5,138,541 A 8/1992 Kano
5,351,172 A 9/1994 Attree et al.
5,537,301 A 7/1996 Martich
5,980,071 A 11/1999 Hsieh
5,993,027 A 11/1999 Yamamoto et al.
6,183,114 B1 2/2001 Cook et al.
6,193,603 B1 2/2001 Tai
6,350,046 B1 2/2002 Lau
6,402,346 B1 6/2002 Liao et al.
6,502,962 B1 1/2003 Menke et al.
6,678,168 B2 1/2004 Kenny, Jr. et al.
6,705,751 B1 3/2004 Liu
6,815,724 B2 11/2004 Dry
6,955,440 B2 10/2005 Niskanen
7,278,761 B2 * 10/2007 Kuan ..... 362/294
2002/0122309 A1 9/2002 Abdelhafez et al.
2004/0141326 A1 7/2004 Dry
2004/0196653 A1 * 10/2004 Clark et al. ..... 362/183
2005/0036322 A1 2/2005 Veffer (Continued)

FOREIGN PATENT DOCUMENTS

JP 2001349095 A * 12/2001

*Primary Examiner*—Sandra L O'Shea
*Assistant Examiner*—Sean P Gramling

(57) ABSTRACT

A luminaire system having an elongated throughway utilizing a thermal chimney effect. The thermal chimney effect within the throughway circulates air to remove heat generated from the electrical components of the system. Dissipating heat into the throughway from the electrical components can increase the life expectancy of the lamp and the output of the lamp. The electrical components of the system being entirely sealed and isolated from the throughway results in a permanent air, dust, and water tight seal. The permanent seal can minimize damage to the electrical components of the system as well as prevent the build up of moisture and dust within these sealed components.

23 Claims, 6 Drawing Sheets

U.S. PATENT DOCUMENTS

2005/0122229 A1 6/2005 Stevenson et al.
2005/0207168 A1 9/2005 Chabert
2005/0276053 A1 12/2005 Nortrup et al.
2006/0109661 A1 5/2006 Coushaine et al.
2006/0164843 A1 7/2006 Adachi et al.
2006/0193139 A1 8/2006 Sun et al.
2007/0030686 A1 2/2007 Haugaard et al.
2007/0091632 A1* 4/2007 Glovatsky et al. ..... 362/547
2007/0279862 A1* 12/2007 Li ..... 361/692

* cited by examiner

LUMINAIRE SYSTEM WITH THERMAL CHIMNEY EFFECT

TECHNICAL FIELD

The present invention relates to a luminaire system and particularly to a luminaire system utilizing thermal chimney effect.

DETAILED DESCRIPTION

Figure 1:
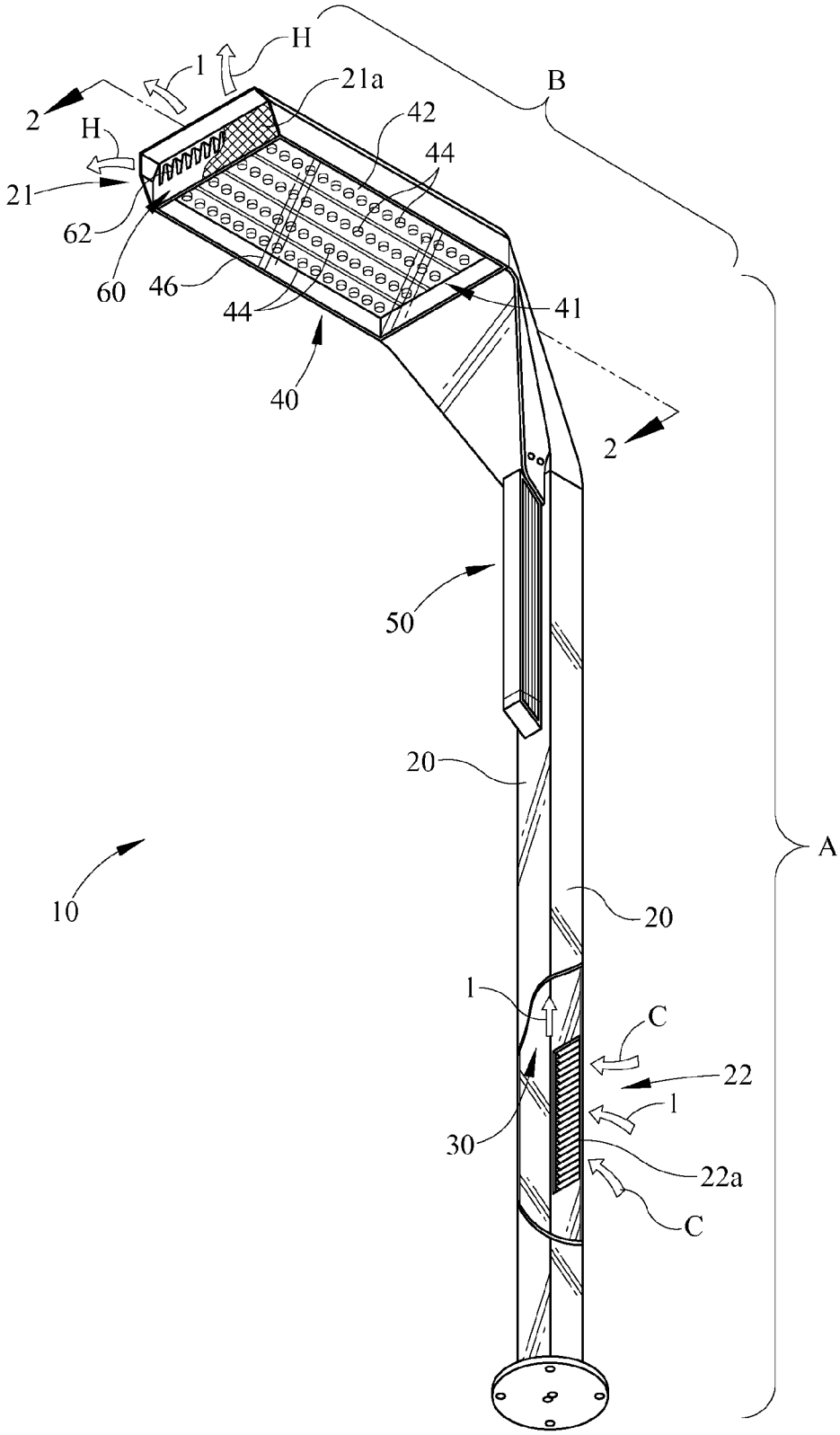
FIG. 1 is a perspective view of an embodiment of a luminaire system with the housing partially broken away showing the chimney inlet and with the screen partially broken away showing the chimney outlet.
Figure 2:
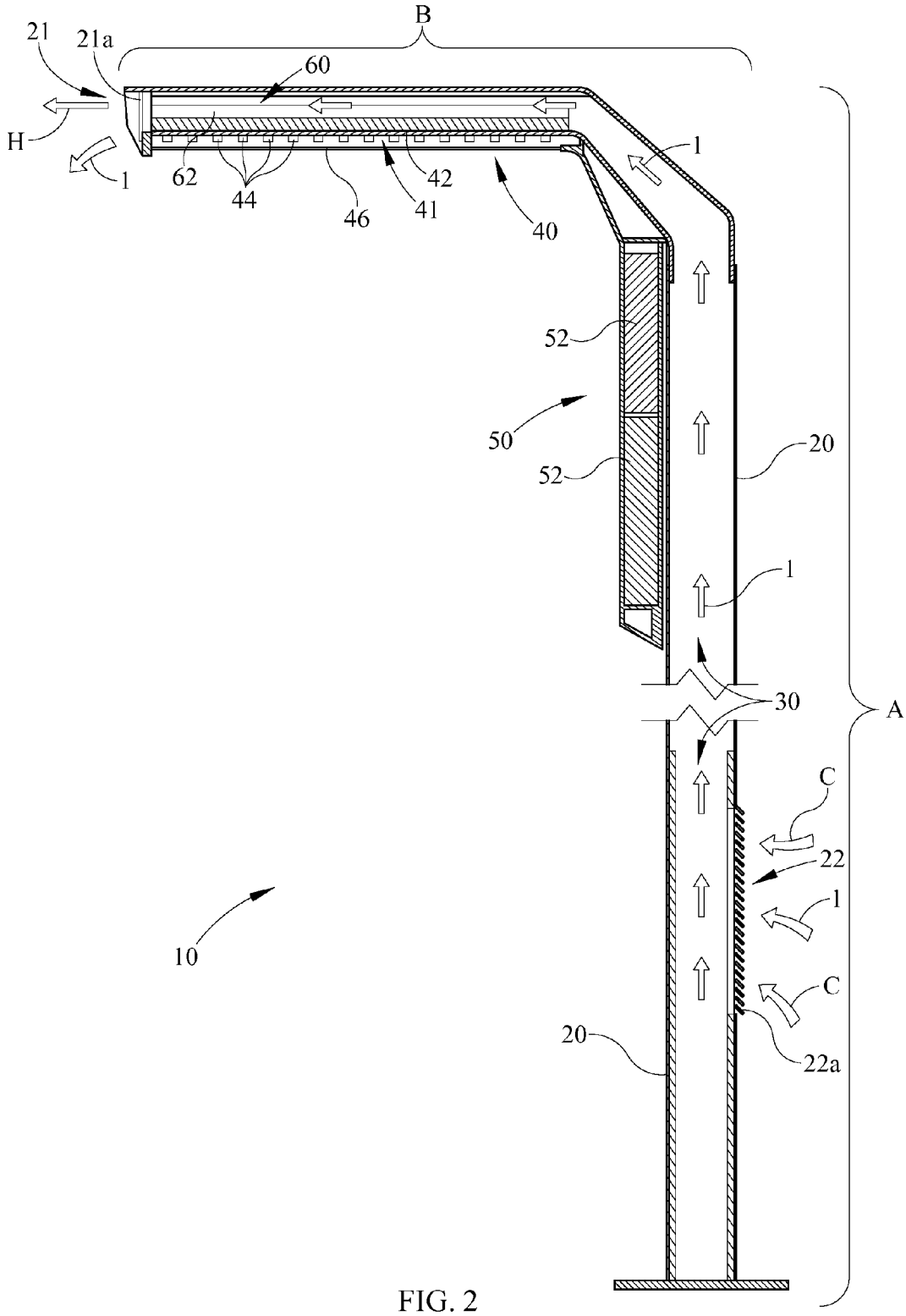
FIG. 2 is an enlarged sectional view of the luminaire system of FIG. 1 taken along line 2-2.

A luminaire system 10 according to one embodiment of the present invention depicted in the FIGS. 1 and 2 has a throughway 30 permitting a "thermal chimney" effect to circulate air 1 through the system. A phenomenon known as "stack effect" is also referred to as "natural ventilation". The stack effect is a result of a temperature difference created within a system in which warm air will rise and exit the system through an opening, being replaced with cooler air from outside the system. However, thermal chimney effect, also referred to as the "solar chimney" is a way of improving the "natural ventilation" of a system by using convection of air heated by an external energy source. In its simplest form, an example of the thermal chimney comprises of a black-painted chimney. During the day passive solar energy heats the chimney and the air within it, creating an updraft of air in the chimney. The luminaire system 10 with thermal chimney effect may be utilized in a variety of applications in use such as but is not limited to an area or pedestrian luminaire (FIGS. 1 and 2), a bollard (FIGS. 3-6), or a modular pole luminaire.

As shown in FIGS. 1 and 2, the luminaire system 10 has an elongated support structure or housing wall 20 having an elongated throughway 30, chimney, flue, or shaft. Housing wall 20 has at least one first opening 21 or chimney outlet disposed above at least one second opening 22 or chimney inlet, thus openings are at different elevations within the support structure. First opening 21 and second opening 22 are interconnected by at least one continuous throughway 30. As shown in FIGS. 1 and 2, throughway 30 may have a substantially vertical throughway stem A with an outwardly extending horizontal throughway section B. Because of the thermal chimney effect, second opening 22 permits cooler air, shown as C, from outside the luminaire system 10 to enter, while the first opening 21 permits the heated air, shown as H, to exit the system. Throughway 30 can be defined by a portion of the walls of the support structure or housing walls 20 as shown in FIGS. 1 and 2 or be a separately formed throughway 130 having distinctive throughway walls 132 substantially separate from housing wall 120 as in FIGS. 3 and 4. Also, first opening 21 and second opening 22 may each have a vent cover 21*a* and 22*a* preventing insects and other foreign objects from entering throughway 30.

Although throughway 30 and openings 21 and 22 are shown in detail in the FIGS. 1 and 2, it is merely representative of one embodiment of the invention. There are a variety of different quantities, shapes, construction, orientation, and dimensions of the each opening 21 and 22 and throughway 30 that may used as understood by those skilled in the art. For example, by varying the length of the throughway and the size of the openings one skilled in the art can make the thermal chimney effect more conducive to a particular use of a specific luminaire system.

Electrical components may be sealed separately and external to the continuous throughway 30 and circulating air 1. As shown in FIGS. 1 and 2, at least one lamp housing 40 is positioned externally to throughway 30. Lamp housing 40 may contain a flat LED panel 41 with an array of LED lamps 44 positioned to indirectly or directly illuminate from luminaire system 10 in a variety of applications. Flat LED panel 41 may include a reflector 42 or reflective surface combined with the array of LED lamps 44. A lens 46 can also be included in lamp housing 40 combining to form a permanently sealed lamp housing. A driver housing 50 containing a driver 52 or ballast may be positioned external to throughway 30 as shown in FIGS. 1 and 2. Any housing containing such electrical components that generate heat for example circuits, lamps, sensors, or the like, can also be externally positioned to the throughway.

Although, luminaire housing wall 20 with lamp housing 40 and driver housing 50 are illustrated in detail in FIGS. 1 and 2, they are merely representative of a luminaire housing and a component housing in general, and it should be understood that there are many variations of luminaire system 10 that may be used with the isolated throughway 30 to permit the thermal chimney effect to circulate air 1 through the system.

The flat LED panel 41, as shown in FIGS. 1 and 2, illustrates the use of a plurality of LED lamps 44 in an array substantially parallel with the throughway 30. The plurality of LED lamps 44 is depicted as approximately 64 LEDs totaling about 128 watts and producing about 13,000 lumens. The flat LED panel 41 is in a substantially horizontal position adjacent horizontal throughway section B of throughway 30 and provide direct illumination from the housing wall. Alternatively, a plurality of horizontal throughway sections B (not shown) with corresponding flat LED panels 41 may extend from a single throughway stem A. Although the flat LED panel 41 is shown in detail in FIGS. 1 and 2, it is to be understood that there are a variety of shapes, positions, sizes, quantities, and efficiencies of the LED panel which may be utilized for direct illumination from the luminaire wall housing and utilize the thermal chimney effect.

The conventional LEDs that may be used in the embodiment of the present invention have increased benefits over conventional bulbs. For example, LEDs produce more light per watt than do incandescent bulbs. LEDs can emit light of an intended color without the use of color filters that traditional light methods require. LEDs have a long life span when conservatively run. LEDs mostly fail by dimming over time, rather than the abrupt burn-out of incandescent bulbs. The solid package of the LED can also be designed to focus its light illumination. However, the performance of the LEDs largely depends on the ambient temperature of the operating environment. Operating the LEDs in high ambient temperatures may result in overheating of the LEDs, eventually leading to device failure.

As shown in FIGS. 1 and 2, housing wall 20 defines throughway 30 through the luminaire system 10. Throughway 30 runs from second opening 22 adjacent to the bottom end of luminaire system 10 and connects to first opening 21 adjacent the free end of system 10. As shown in FIGS. 1 and 2, lamp housing 40 and driver housing 50 are preferably separately sealed and isolated from throughway 30. Alternatively, any electrical component that reacts poorly to increased temperature, moisture, and dust can be sealed from throughway 30 and utilize the thermal chimney effect. Thus, a permanent seal can be maintained with the lamp housing 40 and driver housing 50. These electrical components are not located in throughway 30 and susceptible to dust, moisture, etc., that can arise from circulating air 1 from the outside environment. Dust and moisture may damage the electronics as well as build up on the interior of lens 46 reducing light output of the luminaire system.

The electrical components although separate from throughway 30, thermally conduct heat into the throughway in order to dissipate heat generated while in use. As shown in FIGS. 1-4, the electrical component housings 40, 140 and 50, 150 lie adjacent to throughway 30 or 130 in order to radiate heat through a portion of housing wall 20 or throughway wall 132. Conducted heat warms air 1 within throughway 30 or 130 adjacent each respective housing creating a warm air environment within the throughway. This heated air H will draft up through throughway 30 and exit out of the chimney outlet or first opening 21, whereby cooler air C will be drafted through the chimney inlet or second opening 22 and replace the exiting heated air within the throughway. This continuous circulation of air 1 caused by the thermal chimney effect increases the naturally cooling of the electrical components of the system without allowing the air to pass directly in contact with the electrical components. The air 1 is circulated without the use of mechanical devices, such as fans or the like.

Portions of walls 20 or 132 surrounding throughway 30 or 130 may be conducive to heat conduction from the electrical components. Lamp housing 40, as shown in FIGS. 1 and 2, and other electrical component housings external to throughway 30 may be interconnected to the throughway 30 by a heat sink wall 60 or other conductive material. Heat sink wall 60 increases in temperature during operation and dissipates the heat into throughway 30. Heat sink wall 60 may also be comprised of at least one fin 62 projecting into throughway 30 to achieve a more efficient heat transfer to air 1 inside the throughway. A portion of the throughway wall 132 or portions of luminaire housing wall 20 may be constructed from, but not limited to, members made by the die or permanent mold aluminum casting process. Such aluminum casting members may facilitate the heat conduction into throughway 30.

Although one example of heat sink wall 60 and fins 62 are shown in detail in FIGS. 1 and 2, it is merely representative of heat sinks in general. The heat sink walls may be a variety of different constructions, quantities, shapes, and in various locations within the system and still be used to conduct heat generated by any electric components into the throughway of the system.

The thermal chimney effect within throughway 30 removes heat generated from lamp 44 and other various electrical components, such as the ballast or driver 52. One resultant advantage is a decrease in temperature within the interior of lamp housing 40 and other electrical component housings, such as the driver housing 50, thereby increasing the life expectancy of LED lamps 44 or other electrical components. The decreased temperature surrounding LED lamps 44 can also increase the output of the lamp.

Figure 3:
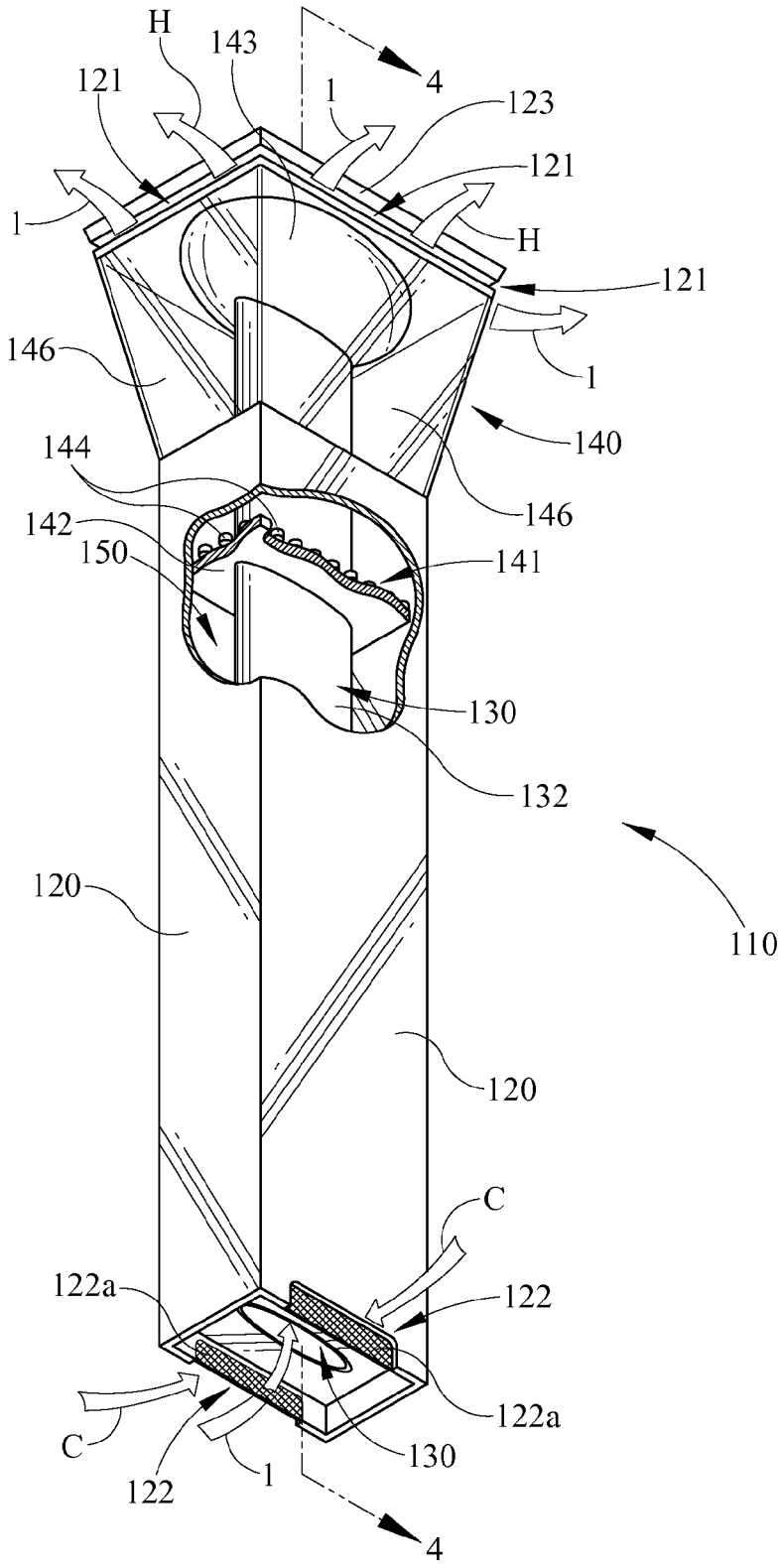
FIG. 3 is a perspective view of another embodiment of a luminaire system with the housing and LED panel partially broken away.
Figure 4:
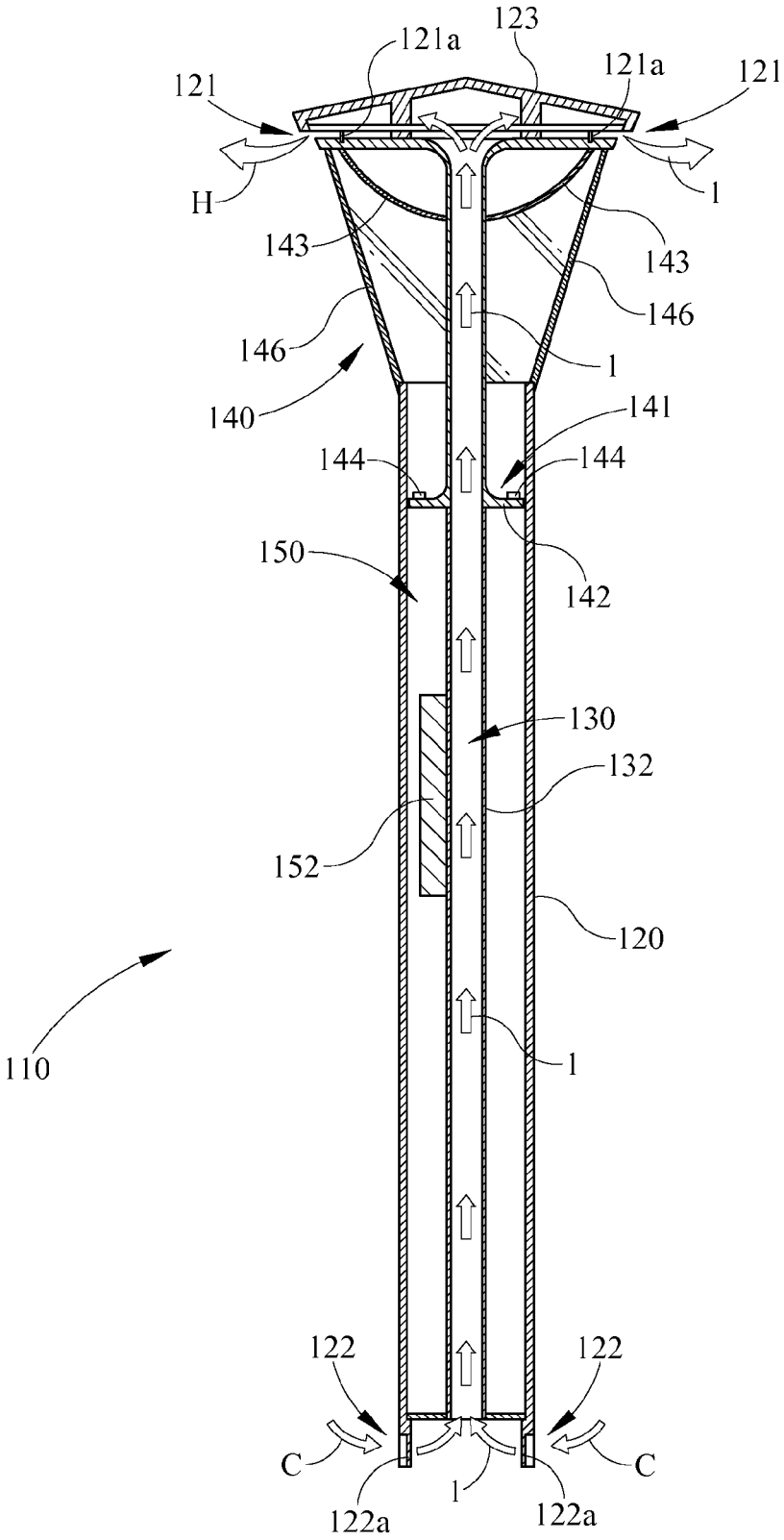
FIG. 4 is a sectional view of the luminaire system of FIG. 3 taken along line 4-4.

Another embodiment permitting a throughway 130, as previously described above, to utilize the thermal chimney effect is shown in FIGS. 3 and 4. In this embodiment, the entire throughway wall 132, or alternatively portions of the wall 132, is positioned separate from the luminaire housing walls 120. Also shown in FIG. 4, throughway 130 is substantially vertical throughout luminaire housing walls 120 unlike throughway 30 of FIGS. 1 and 2. Throughway 130 connects with a first opening 121 exiting from the throughway beneath a cap 123 to the outside of luminaire system 110. Disposed under first opening 121 at the bottom end of luminaire system 110 and also connected to throughway 130 is a second opening 122 which acts to draft in air 1 from the surrounding outside environment. Also, first opening 121 and second opening 122 may each have one or more vent covers 121*a* and 122*a* to prevent insects and other foreign objects from entering throughway 130. Throughway wall 132 has a cross section shown as oval in shape, but is not limited to this particular shape throughout the length, interconnecting second opening 122 to first opening 121. Throughway 130, as described above, may remain separate from the electrical components, such as driver housing 150 with driver 152 and lamp housing 140, creating permanently sealed electrical component housings in thermal contact with throughway 130. The thermal contact may include a heat sink wall and/or heat sink fins (not shown) projecting inside of throughway 130. As shown in FIGS. 3 and 4, lamp housing 140 may include a flat LED panel 141 with lamps 144, lens 146, and reflector 142. Thus, throughway 130 prevents any circulated air 1 from coming into direct contact with electrical components of luminaire system 110.

As shown in FIGS. 3 and 4, lamp housing 140 contains at least one flat LED panel 141 in a substantially perpendicular position with throughway 130 and is capable of conducting heat into the throughway. A substantially rectangular shaped, flat LED panel 141 comprises an array of a plurality of LEDs 144 surrounding throughway 130. Throughway 130 may pass through a substantial portion, if not all, of the perpendicular flat LED panel 141. The plurality of LED lamps 144 are shown in FIGS. 3 and 4 as approximately 24 LEDs surrounding the throughway 130, totaling about 24 or 72 watts and the corresponding 2,000 or 4,000 lumens. Flat LED panel 141 may indirectly illuminate the outside environment of luminaire system 110. Positioned above flat LED panel 141 and below first opening 121 may be an upper reflector 143. Upper reflector 143 redirects or reflects the illumination from flat LED panel 141 to the outside environment. Upper reflector 143 may be of a reflective plastic or plated aluminum surrounding throughway 130. This indirect illumination as shown in FIGS. 3 and 4 reduces or possibly eliminates direct glare from the LED lamps 144. It is to be understood to those skilled in the art that one or both of the flat LED panel 141 and upper reflector 143 may be a number of different shapes, positions, sizes, quantities, and efficiencies and still function to indirectly illuminate the outside environment and utilize the thermal chimney effect of throughway 130.

Figure 5:
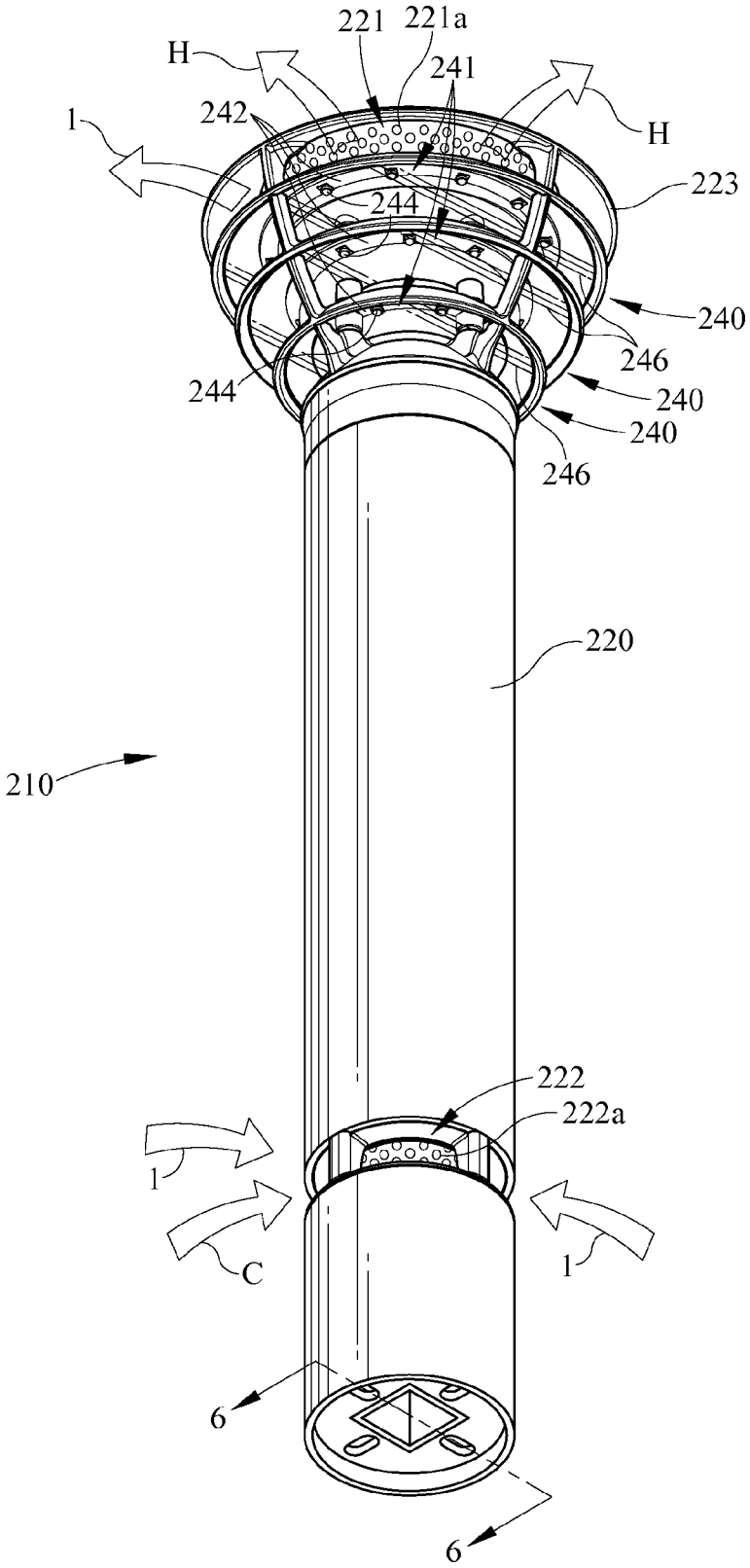
FIG. 5 is a perspective view of another embodiment of a luminaire system.
Figure 6:
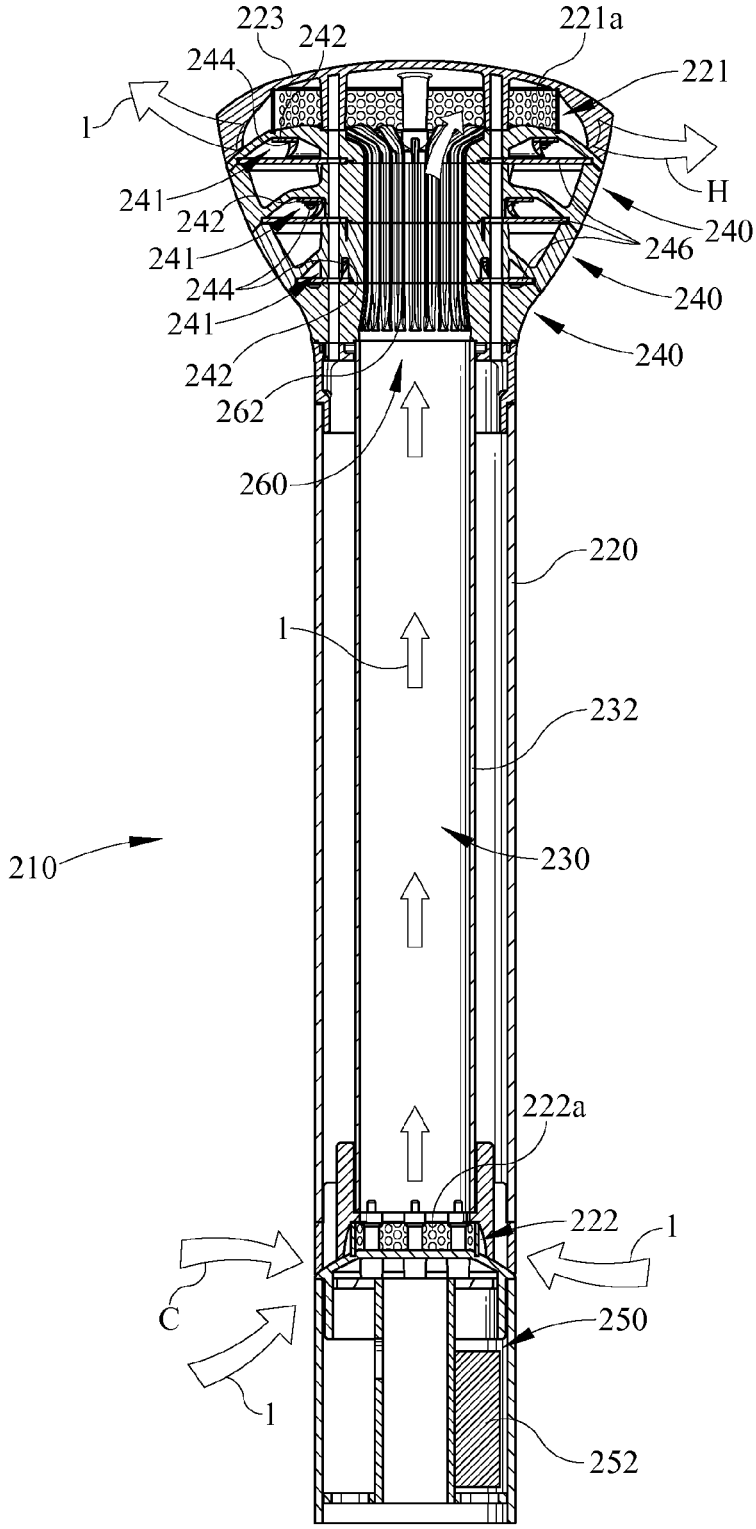
FIG. 6 is a sectional view of the luminaire system of FIG. 5 taken along line 6-6.

Another embodiment of a luminaire system 210 utilizing the thermal chimney effect is shown in FIGS. 5 and 6. In this embodiment, a substantial portion of the throughway wall 232 is positioned separate from the luminaire housing wall 220. Throughway 230 is substantially vertical and concentric throughout luminaire housing wall 220. A second opening 222 is offset from the bottom end of the luminaire system connecting the throughway 230 with a first opening 221. Second opening 222 acts to draft in air 1 from the surrounding outside environment through throughway 230 removing heat generated from one or more of a circular shaped LED panels 241 adjacent to the throughway which exits from first opening 221 beneath a cap 223 to the outside of luminaire system 210. Also, first opening 221 and second opening 222 may each have one or more vent covers 221*a* and 222*a* to prevent insects and other foreign objects from entering throughway 230. Throughway 230, as described above, may remain separate from the electrical components, such as driver housing 250 with driver 252 and lamp housing 240, creating permanently sealed electrical component housings in thermal contact with throughway 130. Adjoining at least between the plurality of circular LED panels 241 and throughway 230 may be a heat sink wall 260 removing heat from the circular LED panels or lamp housings 240 while the plurality of LED lamps are in operation. Projecting from heat sink wall 260, may be one or more heat sink fins 262 as shown in FIG. 6. As shown in FIGS. 5 and 6, one or more lamp housings 240 each include a plurality of lamps 244 from circular LED panel 241, a lens 246, and reflector 242.

As shown in FIGS. 5 and 6, luminaire system 210 has a plurality of lamp housings 240. Within each lamp housing 240 is circular shaped LED panel 241 surrounding throughway 230. Each circular LED panel 241 is vertically offset from each other along throughway 230 and sequentially increasing in diameter. Potentially with each succession of increasing diameter more LED lamps 244 may be circumferentially spaced along the circular LED panel 241. Each corresponding lens 246 may also increase in diameter along with each corresponding circular LED panel 241. The plurality of LED lamps 244 may comprise of approximately 27 LEDs totaling 27 watts and producing 2160 lumens. As shown in FIGS. 5 and 6, circular LED panels 241 are positioned perpendicular to throughway 230 and may indirectly illuminate the outside environment from the housing wall 220.

It is to be understood that the external heat source generated while LED panels 41, 141, and 241 are in operation may be introduced within throughway 30, 130, and 230 or elongated shaft at the upper end of the throughway or alternatively be positioned at a variety of lengths thereof. It is also to be understood to those skilled in the art that throughway 30, 130, and 230 may be provided with a variety of heights, cross-sections, and thermal properties contributing to the efficiency of the thermal chimney effect. Inlet and outlet openings of the throughway may also be a variety of sizes, locations, and shapes contributing to the thermal chimney effect.

It is to be understood that while certain embodiments of the invention have been illustrated and described, it is not limited thereto except insofar as such limitations are included in the following claims and allowable functional equivalents thereof.

I claim:

1. A pole system for a LED based lighting fixture comprising:

an elongated substantially vertical support pole;

said lighting fixture being adjacent a first upper end of said support pole and having at least one LED panel, wherein said at least one LED panel indirectly or directly illuminates from said lighting fixture;

a cooling channel formed by a substantially vertical elongated shaft extending from a first opening proximate said first upper end of said support pole to a second opening proximate a second lower end of said support pole, said first opening being in flow communication with said second opening, said light fixture having said at least one LED panel externally sealed from and positioned adjacent to said elongated shaft at least partially between said first opening and said second opening, wherein said light fixture is not in fluid communication with said elongated shaft while maintaining thermal conductivity with said elongated shaft;

a heat sink wall in thermal contact with said at least one LED panel and said shaft;

whereby a cooling convection flow of air passes into said second opening and through said cooling channel and past said heat sink wall to exit at said first opening, thereby cooling said at least one LED panel when said at least one LED panel is in operation.

2. The pole system as in claim 1 wherein said heat sink wall includes one or more fins projecting inside said cooling channel.

3. The pole system as in claim 1 wherein said at least one LED panel positioned substantially parallel with said shaft.

4. The pole system as in claim 1 wherein said at least one LED panel positioned substantially perpendicular with said shaft.

5. The pole system as in claim 1 wherein said at least one LED panel surrounds said shaft.

6. The pole system as in claim 1 wherein a screen covers one or both of said first opening and said second opening to prevent entry of contaminants within said shaft.

7. The pole system as in claim 1 further comprising an upper reflector disposed about said at least one LED panel for indirect illumination from said light fixture.

8. The pole system as in claim 1 further comprising a second housing having electronics for illuminating said at least one LED panel within said pole and externally sealed from and thermally connected to said cooling channel.

9. The pole system as in claim 1 wherein said shaft is substantially separate from one or more walls of said pole.

10. A decorative pole lighting system comprising:

an elongated support pole having an upper end and a lower end;

a light fixture affixed to said upper end of said support pole having at least one LED panel;

said support pole having a chimney inlet proximate said lower end of said pole and a chimney outlet proximate said upper end of said pole;

a cooling channel formed by a chimney extending within said support pole and connecting said chimney inlet to said chimney outlet, wherein electronics of said light fixture are not in contact with the air circulating within said chimney;

said at least one LED panel of said light fixture adjacent and external to said chimney and externally sealed from said chimney, wherein said at least one LED panel is in thermal contact with said chimney and surrounds said chimney;

a reflector disposed adjacent said at least one LED panel for indirect illumination from said light fixture; and whereby a cooling convection flow of air passes into said chimney inlet and through said cooling channel to exit at said chimney outlet when said at least one LED panel is in operation, thereby cooling said at least one LED panel when heat transfers from said at least one LED into said cooling channel.

11. The decorative pole lighting system as in claim 10 further comprising a heat sink wall in thermal contact with said at least one LED panel and said chimney.

12. The decorative pole lighting system as in claim 11 wherein said heat sink wall includes one or more fins projecting inside said cooling channel.

13. The decorative pole lighting system as in claim 10 wherein said at least one LED panel positioned substantially perpendicular with said chimney.

14. The decorative pole lighting system as in claim 10 wherein a screen covers one or both of said chimney inlet and said chimney outlet to prevent entry of contaminants within said chimney.

15. The decorative pole lighting system as in claim 10 wherein said chimney is substantially vertical in shape.

16. The decorative pole lighting system as in claim 10 wherein said chimney is substantially separate from one or more walls of said support pole.

17. A luminaire system comprising:

an elongated substantially vertical pole having a first opening proximate a first end of said pole and a second opening proximate a second opposite end of said pole;

a cooling channel formed by a chimney extending within said pole and connecting said first opening to said second opening, said cooling channel is not in fluid communication with electrical components of said luminaire;

a lamp housing having a plurality of offset circular LED panels adjacent and external to said chimney and positioned at least partially between said first opening and said second opening of said pole while preventing fluid communication with said cooling channel, wherein said plurality of offset circular LED panels is in thermal contact with said chimney, wherein each successive offset circular LED panel increase in diameter and surround said chimney; and whereby a cooling convection flow of air passes into said second opening and through said cooling channel to exit at said first opening when said plurality of circular LED panels are in operation, thereby cooling said plurality of offset circular LED panels.

18. The luminaire system as in claim 17 further comprising a heat sink wall in thermal contact with said plurality of circular LED panels and said chimney.

19. The luminaire system as in claim 18 wherein said heat sink wall includes one or more fins projecting inside said cooling channel.

20. The luminaire system as in claim 17 wherein said plurality of circular LED panels positioned substantially perpendicular with said chimney.

21. The luminaire system as in claim 17 wherein a screen covers one or both of said first opening and said second opening to prevent entry of contaminants within said chimney.

22. The luminaire system as in claim 17 wherein said chimney is substantially separate from one or more walls of said pole.

23. A pole system for a LED based lighting fixture comprising:

a support pole having an elongated cooling channel connecting a first opening adjacent an upper end of said support pole to a second opening adjacent a lower end of said support pole;

an illumination region adjacent said upper end of said support pole having a LED panel externally sealed from and adjacent to said elongated cooling channel, wherein said LED panel is not in fluid communication with said elongated cooling channel while being thermally connected to said elongated cooling channel and wherein said LED panel substantially surrounds said elongated cooling channel;

a power supply region having an electrical component housing powering said LED panel and externally sealed from and adjacent to said elongated cooling channel, wherein said electrical component housing encloses at least one LED driver and is not in fluid communication with said elongated cooling channel while being thermally connected to said elongated cooling channel;

whereby a cooling convection flow of air passes into said second opening and through said elongated cooling channel and exits at said first opening, thereby cooling each of said LED panel and said electrical component housing that are thermally connected with said elongated cooling channel when said LED panel is in operation.

* * * * *